US005143218A

United States Patent [19]

Brauckmann

[11] Patent Number: 5,143,218

[45] Date of Patent: Sep. 1, 1992

[54] SELF-SERVICE PACKAGE FOR SMALL PARTS WITH RUPTURABLE LABEL

[75] Inventor: Friedrich-Wilhelm Brauckmann, Lüdenscheid, Fed. Rep. of Germany

[73] Assignee: Brauckmann & Pröbesting GmbH & Co. KG, Lüdenscheid, Fed. Rep. of Germany

[21] Appl. No.: 663,906

[22] PCT Filed: Aug. 25, 1989

[86] PCT No.: PCT/DE89/00558

§ 371 Date: Mar. 4, 1991

§ 102(e) Date: Mar. 4, 1991

[87] PCT Pub. No.: WO90/02693

PCT Pub. Date: Mar. 22, 1990

[30] Foreign Application Priority Data

Sep. 2, 1988 [DE] Fed. Rep. of Germany ..... 3829778

[51] Int. Cl.[5] ..... B65D 73/00

[52] U.S. Cl. ..... 206/467; 40/312; 206/807; 220/306; 220/339; 220/352

[58] Field of Search ..... 206/461, 467, 470, 807, 206/459, 813, 1.5; 220/306, 339, 352; 40/312, 638

[56] References Cited

U.S. PATENT DOCUMENTS

| | | | |
|---|---|---|---|
| 355,914 | 1/1887 | Bisler | 40/312 |
| 1,828,680 | 10/1931 | Rado | 40/312 |
| 2,153,310 | 4/1939 | Newman | 40/638 X |
| 3,511,433 | 5/1970 | Andrews et al. | 220/339 X |
| 3,648,833 | 3/1972 | Dash | 40/312 X |
| 3,698,551 | 10/1972 | Tomlinson | 206/459 X |
| 4,007,828 | 2/1977 | Mayled | 206/1.5 |
| 4,091,927 | 5/1978 | Lunsford | 206/459 |
| 4,102,452 | 7/1978 | Sato et al. | 220/339 X |
| 4,202,464 | 5/1980 | Mohs et al. | 220/339 |
| 4,319,684 | 3/1982 | Backman et al. | 206/467 X |
| 4,437,566 | 3/1984 | Szahler | 206/1.5 |
| 4,499,353 | 2/1985 | Shields | 206/470 |
| 4,520,921 | 6/1985 | Vissing | 220/306 X |
| 4,570,818 | 2/1986 | Borst et al. | 220/339 |

FOREIGN PATENT DOCUMENTS 2448319 9/1980 France .

*Primary Examiner*—Bryon P. Gehman
*Attorney, Agent, or Firm*—Herbert Dubno; Yuri Kateshov

[57] ABSTRACT

A self-service package is provided with a cup-shaped bottom part formed with a perimeter wall and with a cup-shaped lid part having a respective perimeter wall overlapping the perimeter wall of the bottom part and provided with an opening covered by an adhesive label reaching a portion of the bottom part in the closed position of the package.

3 Claims, 2 Drawing Sheets

SELF-SERVICE PACKAGE FOR SMALL PARTS WITH RUPTURABLE LABEL

CROSS REFERENCE TO RELATED APPLICATION

This application is a national phase of PCT/DE/89/00558 filed Aug. 25, 1989 and based, in turn, upon German national application P 3829 778.7 filed Sep. 2, 1988 under the International Convention.

1. Field of the Invention

The invention relates to a package for small parts, consisting of a cup-shaped bottom and a cup-shaped lid, whereby the bottom and the lid facing each other with their open portions can be slipped onto each other and the lateral walls of the lid overlap with those of the bottom part, as well as of an adhesive label which is glued to the lid.

2. Background of the Invention

Two-part packages for self-service are widely known in the art. For instance, reference can be made to U.S. Pat. No. 4,619,364. It is also customary for the self-service package to have adhesive signs or the like on the lid surface, containing information about the goods and/or price of the corresponding goods.

As a rule, an adhesive label is affixed to cover the frontal surface and the lateral surfaces, as well as the back wall of the package, so that its tamper-proof function is fulfilled, since the package can be opened only by destroying or tearing the label. However, affixing such safety labels is relatively difficult, since the placing of the label can be done only when the package is lifted from its support, in order to place the label on its back wall.

OBJECTS OF THE INVENTION

It is therefore, a principle object of the present invention to provide a package or box for self-service of the generic kind having an adhesive label or the like serving as tamper-proof closure of the package and affixed to the package while it is resting on a support.

SUMMARY OF THE INVENTION

According to the invention at least one wall of the box, particularly a lateral wall of a lid portion, is provided with an opening. The adhesive label can be affixed to the wall, particularly the lateral wall and, covers the opening while reaching parts of the bottom wall located underneath this opening in the closed position of the package.

Solutions to this problem are known to the state of the art, wherein an adhesive label is affixed to cover the frontal surface and the lateral surfaces, as well as the back wall of the package, so that its tamper-proof function is fulfilled, since the package can be opened only by destroying, respectively tearing the label, however affixing such safety labels is relatively difficult, since the placing of the label can be done only when the package is lifted from its support, in order to place the label also on its back wall.

The structure according to the invention enables affixing the adhesive label to a package resting on a support, without lifting the package from its support. For instance, in order to fill the package the cup-shaped bottom part is transported on a conveyor belt or the like and directed towards certain filling stations. In the following step the lid portion is fitted over the bottom and after that the adhesive label is affixed over the area provided with the window-like opening. The lid can be affixed to the bottom portion by means of articulated joints or can be an independent part. When the lid thickness is relatively small, the adhesive layer of the lid portion reaches the outside wall surface of the cup-shaped bottom portion located underneath the window-like opening, so that the adhesive label is glued to the outside of the lid wall and to the outside of the bottom wall as well. The opening of the package is possible only when the adhesive label is removed or destroyed. In the case of two-part packages it is possible and often necessary to provide several openings at several spots of the lid, each being covered by a respective adhesive label or all of them covered by one continuous label.

A particularly advantageous embodiment of present invention has the wall, particularly the lateral wall of the bottom part with a surface projecting towards the respective confronting wall of the covering lid portion. The projection can be fitted into the opening, thereby being approximately flush with the external surface of the lateral wall of the lid.

This structure insures that the wall portion of the bottom part provided with the adhesive label is at the same level with the external wall of the lid part in the area of the opening, so that a corresponding adhesive label can be easily affixed to cover the surface of both of these areas.

Even after the removal or prior to the affixing of the adhesive label, the package is kept together by the projecting surface of the bottom part engaging in the opening of the lid part, so that a certain locking connection is created.

BRIEF DESCRIPTION OF THE DRAWING

The above and other features, objects and advantages will become more readily available from the following description, reference being made to the accompanying drawing in which.

SPECIFIC DESCRIPTION

Figure 1:
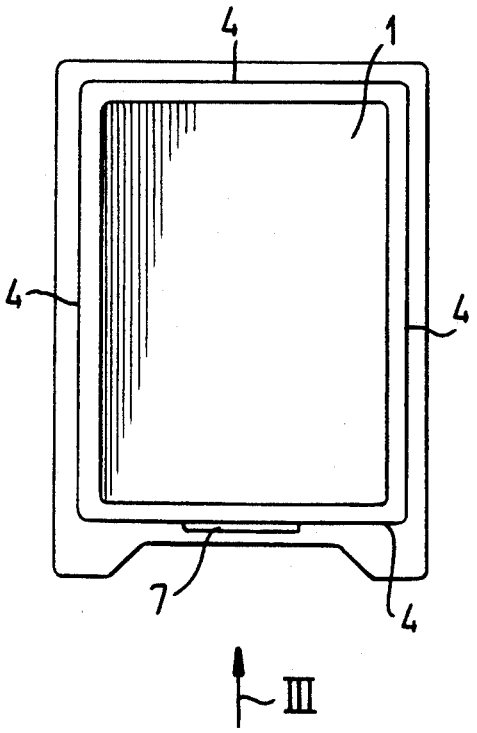
FIG. 1 is a top view of a bottom part.
Figure 2:
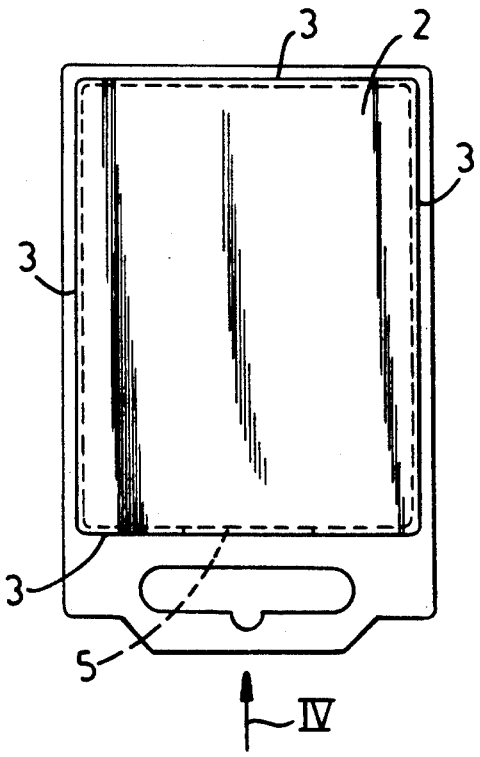
FIG. 2 is a top view of a lid.
Figure 4:
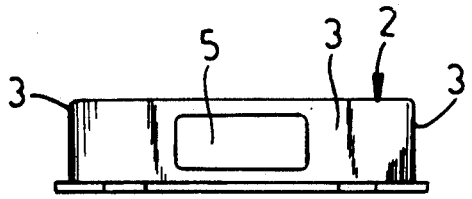
FIG. 4 is a front view of the lid portion provided with the opening, and seen in the direction of arrow IV of FIG. 2.
Figure 5:
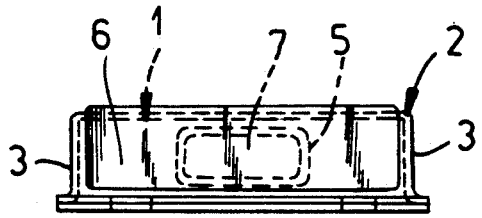
FIG. 5 is a front view of the assembled box a label affixed thereto.
Figure 3:
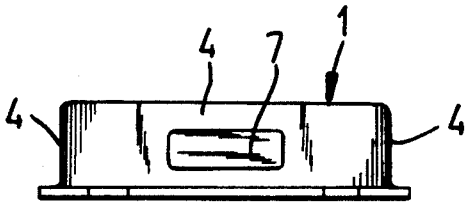
FIG. 3 is a front view of the bottom part seen in the direction of the arrow III of FIG. 1.

The self-service package for small parts, for instance small hardware, small tools, small craftwork supply items or the like consists essentially of a cup-shaped bottom part 1 of rectangular configuration and of a cup-shaped lid part 2 having the same geometric base shape. The lid part and the bottom part are slipped over each other with their mutually facing openings, whereby the lid 2 is fitted over the bottom 1.

Thereby, the lid part 2 overlaps with its lateral walls 3 the lateral walls 4 of the bottom part. According to the invention, at least one wall, e.g. the lateral wall 3 of the lid part 2 (FIGS. 1-5), is provided with a window-like opening 5, so that after the lid 2 is fitted over the bottom part 1, an adhesive label 6 can be glued over the corresponding lateral wall 3 provided with the opening 5.

The adhesive label 6 can, at the same time, reach the wall portions of the lateral wall 4 of the bottom part located underneath the window-like opening 5. Preferably, the lateral wall 4 of the bottom part 1 has a surface 7 projecting towards the lateral wall 3 of the covering lid 2, this projection being insertable in the window-like opening 5 when the lid part 2 is fitted over the bottom part 1. The outer surface of projection 7 is approximately flush with the external surface of the lateral wall 3 of lid part 2, so that an affixed adhesive label 6 lies with its entire surface on the corresponding portions of the lateral wall 3 and the projecting surface 7.

The opening of the package is possible only when the label is destroyed or removed. It is possible to affix the adhesive label 6 for the purpose of creating a tamper-proof closure also when the bottom part 1 rests on a support, for instance a conveyor belt.

Due to the arrangement of the projecting surface 7 and the fact that it engages in the window-like opening 5, an additional locking connection between the lid and the bottom parts is created, so that after the adhesive label 6 is removed or destroyed, the user can lock to each other both parts of the self-service package.

Of course, it is conceivable to provide the window-like openings 5 and also the correspondingly projecting surfaces 7 at several lateral areas of the lid 2 or the bottom part 1. Further, it is possible to mold the lid part 2 to one edge of the bottom part, for instance to the edge of the bottom part opposite to the projecting surface 7, via a film hinge or the like. Normally, such self-service packages can be made of plastic material. It is also possible to produce them through deep drawing of plastic foil materials.

Figure 7:
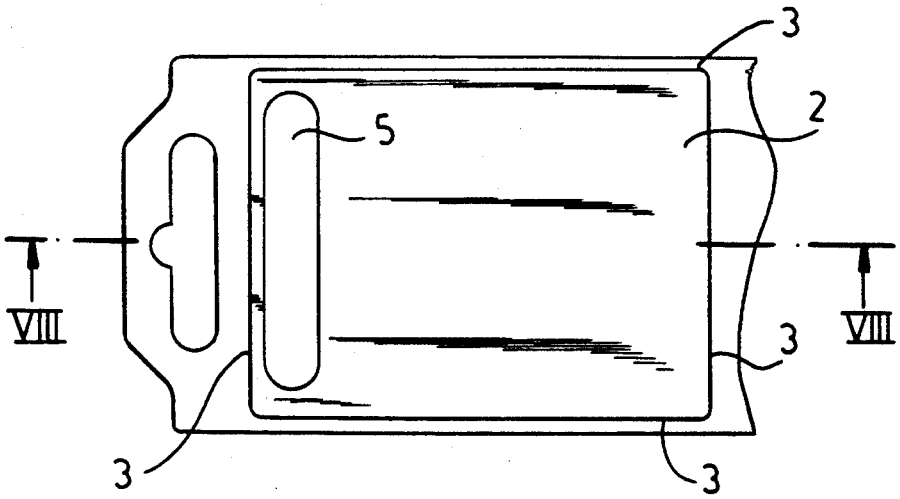
FIG. 7 is a top view of the lid of the embodiment of FIG. 6.
Figure 6:
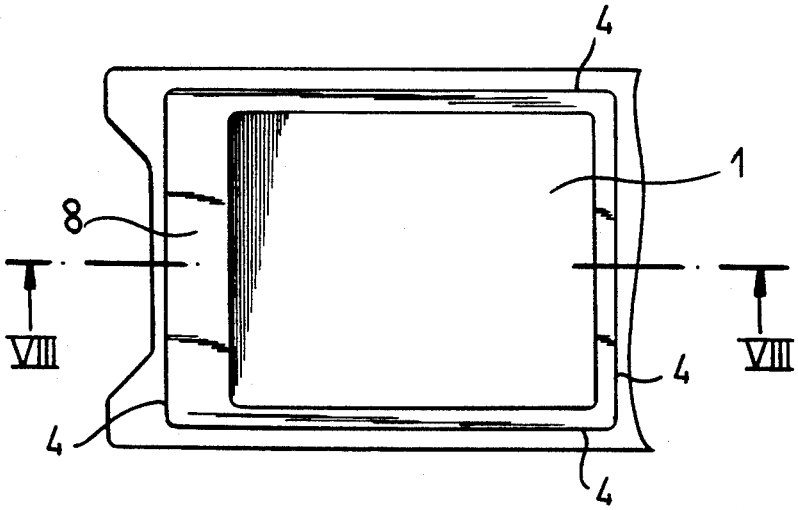
FIG. 6 is a top view of the bottom part according to another embodiment of the present invention.
Figure 8:
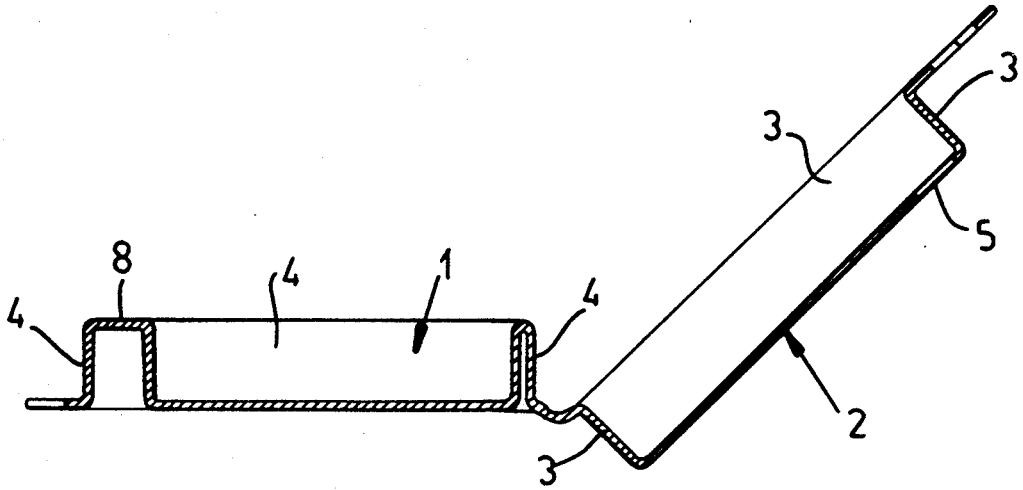
FIG. 8 is a section taken along lines VIII—VIV of FIGS. 6 and 7 of a package made in one piece.

In the embodiment example according to FIGS. 6–8, the bottom part 1 is provided with a wide edge portion 8 located in the place of the opening. Correspondingly, the lid part 2 has in the area of its frontal surface overlying the edge area 8 (in the closed position) an opening 5, which makes it possible for a label 6 through its adhesive layer to be affixed through the opening 5 to connect the outer surface of the frontal area of the lid 2 and the area 8 of the bottom part 1, located underneath the opening 5.

It is also possible to combine the features according to FIGS. 1 to 5 with the ones according to FIGS. 6 to 8.

In FIG. 8, a hinge-like single-piece design of the lid and bottom parts is shown.

I claim:

1. A self-service package assembly for small parts comprising:

a cup-shaped bottom part provided with:

a bottom, and a perimeter wall extending outwardly from said bottom;

a cup-shaped lid part provided with:

a top, a respective perimeter wall extending inwardly from said top and formed with an inner side and an outer side, said perimeter wall of said lid part being formed with an opening entirely bounded by the perimeter wall of the lid part, said wall of said lid part overlapping said wall of said bottom part in a closed position of said package, so that said top and bottom are spaced from and face each other; and an adhesive label on said outer side of said perimeter wall of said lid part, said label covering said opening and adhered to said peripheral wall of said bottom part substantially only within said opening in said closed position.

2. The self-service package assembly defined in claim 1 wherein said perimeter wall of said bottom part has a projection extending laterally toward the wall of the lid part and flush with the outer side thereof in said closed position of said package.

3. The self-service package assembly defined in claim 1, wherein each of said perimeter walls is provided with:

a respective pair of lateral sides, and front and rear sides bridging said lateral sides, the respective front side of said lid part being provided with said opening.

* * * * *